US008968119B2

(12) United States Patent
Mattern

(10) Patent No.: US 8,968,119 B2
(45) Date of Patent: Mar. 3, 2015

(54) WEIGHTED SWING TRAINING APPARATUS

(75) Inventor: Erik Josef Mattern, Corona Del Mar, CA (US)

(73) Assignee: Mattern Enterprises, LLC, Rancho Santa Margarita, CA (US)

( * ) Notice: Subject to any disclaimer, the term of this patent is extended or adjusted under 35 U.S.C. 154(b) by 369 days.

(21) Appl. No.: 13/136,060

(22) Filed: Jul. 21, 2011

(65) Prior Publication Data

US 2013/0023360 A1 Jan. 24, 2013

(51) Int. Cl.

| | |
|---|---|
| ***A63B 69/00*** | (2006.01) |
| ***A63B 15/00*** | (2006.01) |
| *A63B 59/06* | (2006.01) |
| *A63B 49/04* | (2006.01) |

(52) U.S. Cl.

CPC ..... *A63B 15/00* (2013.01); *A63B 69/0002* (2013.01); *A63B 59/06* (2013.01); *A63B 49/04* (2013.01); *A63B 2069/0008* (2013.01)

USPC ..... 473/437

(58) Field of Classification Search

USPC ..... 473/453, 458, 519, 564, 437

See application file for complete search history.

(56) References Cited

U.S. PATENT DOCUMENTS

| | | | | |
|---|---|---|---|---|
| 2,983,638 | A * | 5/1961 | Quehl, Jr. | 156/581 |
| 3,330,560 | A * | 7/1967 | Higdon | 473/437 |
| 3,392,976 | A * | 7/1968 | Hayes | 473/564 |
| 3,414,260 | A * | 12/1968 | Gust | 482/109 |
| 3,623,724 | A | 11/1971 | Lande | |
| 5,024,436 | A | 6/1991 | Vento | |
| 5,050,877 | A | 9/1991 | Wales | |
| 5,980,397 | A * | 11/1999 | Hart et al. | 473/437 |
| 6,190,271 | B1 * | 2/2001 | Rappaport et al. | 473/451 |
| 6,533,685 | B1 * | 3/2003 | Otten et al. | 473/437 |
| 6,739,989 | B2 | 5/2004 | Liberatore | |
| 7,128,667 | B2 | 10/2006 | Nolan | |
| 7,344,457 | B2 | 3/2008 | Liberatore | |
| 8,231,484 | B1 * | 7/2012 | Quinn | 473/437 |
| 2004/0063519 | A1 * | 4/2004 | Liberatore | 473/457 |
| 2004/0209711 | A1 * | 10/2004 | Liberatore | 473/457 |
| 2006/0025246 | A1 * | 2/2006 | Forney et al. | 473/457 |
| 2006/0084530 | A1 | 4/2006 | Cheeseman | |
| 2007/0123371 | A1 * | 5/2007 | Liberatore | 473/457 |
| 2008/0261729 | A1 * | 10/2008 | Mullin | 473/457 |
| 2009/0069126 | A1 * | 3/2009 | Merchant | 473/437 |
| 2010/0137078 | A1 | 6/2010 | Liberatore | |
| 2013/0023360 | A1 * | 1/2013 | Mattern | 473/437 |

OTHER PUBLICATIONS

Webpage download, foamorder, 2009, web.archive.org/web/20090228180251/http://www.foamorder.com/neoprene.html, 4 pages.*

* cited by examiner

*Primary Examiner* — Gene Kim
*Assistant Examiner* — M Chambers
(74) *Attorney, Agent, or Firm* — Jay B. Johnson

(57) ABSTRACT

A weight apparatus is provided. The apparatus may be attached to a sports device, such as a baseball bat or other device which may be swung by a user. In one configuration, the apparatus has a body portion that at least partially surrounds a portion of the swingable device. As an example, the body portion may act as a sleeve surrounding an end of the device opposite the end of the device which is gripped by the user. The apparatus also has a weighted portion, which is coupled to the body portion. The weighted portion is disposed at least partially adjacent an end of the swingable device. In certain configurations the apparatus has a center of balance between a midpoint and one end of the apparatus. In certain cases, the weighted portion distributes weight closer to a distal end of the swingable device, in order to assist a user in warming up or otherwise training with the device.

14 Claims, 4 Drawing Sheets

WEIGHTED SWING TRAINING APPARATUS

TECHNICAL FIELD

The disclosure relates generally to sports training equipment and, more particularly, to an apparatus to attach to a sports device for swinging by a user, such that the apparatus assists the user in training related to swinging the sports device.

BACKGROUND

Warm up weights for baseball bats are generally known. Such weights may be mounted on the shaft of the bat to provide extra weight in addition to the weight of the bat itself. The extra weight assists in warming up the batter during practice swings, such as might be taken during an "on deck" period in which the batter is waiting to take his or her turn at bat.

A common bat weight is known as a "donut" because of its donut-like shape. In geometric terms, this shape may be referred to as a "ring torus," or simply "torus." The ring torus has a hole through which the bat is inserted. Typically, the bat would be inserted handle-end-first. This is because the handle end of the bat is smaller than the striking end of the bat. Thus, when the handle-end of the bat is inserted in to the torus hole, the torus may be slid down the shaft of the bat until the diameter of the bat becomes larger than the diameter of the torus hole. At this point the torus stops. Another way of viewing the use of the donut is to slide the donut onto the handle-end of the bat, usually with the bat in a vertical orientation with the handle end above the striking end. Thus, the donut drops down the bat until it reaches the point where the bat diameter exceeds the donut-hole diameter and the donut stops. Often, a player will tap the bat on the ground to ensure that the donut stays in this position.

Commonly, baseball bat donuts are made of a weighted ring, coated in a rubber material that will hold the donut shape, but will give a little to tighten up the engagement of the donut with the bat surface. The donuts may come in different sizes and/or weights such that a player may put different or multiple donuts on a bat to achieve a preferred swing training, or warm up, weight.

SUMMARY

Certain embodiments of the invention provide an apparatus that may be attached to a swingable device to add weight to the device in order to assist a user in strengthening or otherwise training their swing technique, or in engaging in a warm up exercise. The device may be a sporting device such as, for example, a baseball bat. When used with a sports device, the apparatus may be viewed as a sports swing training apparatus. At least a portion of the apparatus is weighted and distributes at least some of the weight of the apparatus to a point adjacent the tip-end of the device or to a point beyond the end of a swing-type sporting device.

In at least one embodiment, an apparatus is provided for use with a swingable device. The device has a first end and a second end and the first end is adapted to be held by a user to swing the device. The apparatus includes a body portion adapted to attach to a portion of the device. The apparatus also includes a weighted portion coupled to the body portion. The weighted portion is at least partially disposed adjacent the second end of the device when the body portion is attached to the device.

In another example embodiment, a bat weight apparatus is provided for attachment to a baseball bat. The bat weight apparatus includes a body portion that has an inner surface defining a cavity. The cavity of the body portion is adapted to at least partially surround at least a portion of the bat to attach to the bat by contact between the inner surface of the body portion and a surface of the bat. The bat weight apparatus also includes a weighted portion coupled to the body portion. The weighted portion is disposed at least partially adjacent a striking end of the bat when the body portion is attached to the bat.

One or more of the embodiments may provide some, none, or all of certain of the following advantage. One advantage is that weight of the apparatus is distributed as close to, or in some cases beyond, the end of the device to which the apparatus is attached. This may improve the training aspects of the apparatus in that moving the weight further away from the user increases the moment about a vertical axis of the user. Stated differently, attaching the apparatus to the device moves a center of balance of the device further away from the user. Thus, the user feels more effective weight during the swinging of the device. Another advantage of the apparatus is that it acts as a protective sleeve to protect the surface of at least a portion of the device to which it is attached.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

Various embodiments are illustrated in FIGS. 1-4. In summary, the various embodiments provide an apparatus for use with a swingable sports device. For example, a swingable sports device might be a baseball bat. The apparatus may serve as a weighted attachment to attach to the sports device. The weighted apparatus may be configured to distribute its weight toward, adjacent to, and (in some embodiments) beyond the end of the sports device opposite the end gripped by the user. Thus, in the baseball bat example, the apparatus would distribute at least some of its weight to a point adjacent to or beyond the striking end of the baseball bat. In certain embodiments, the apparatus has a body portion that attaches to the sports device in a friction-fit, sleeve-type manner.

Figure 1:
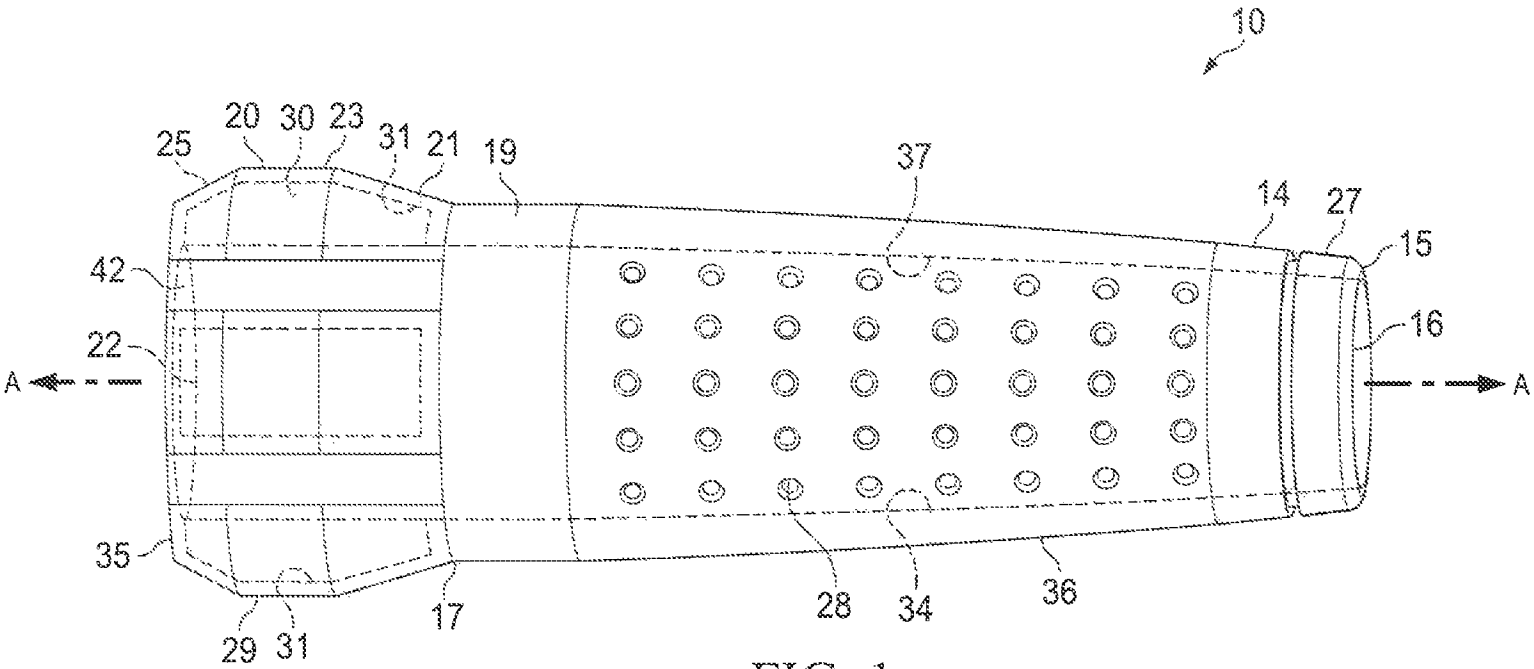
FIG. 1 is a perspective view of an apparatus having a plurality of distinct weight structures according to an example embodiment.

As shown in FIG. 1, for example, an apparatus 10 is provided. Apparatus 10 may be used together with any suitable device, such as a sports device for example, that may be swung by a user. Such devices may be referred to herein as swingable devices. Although the embodiments are not so limited, an example of such a swingable device is a baseball bat. Other devices might include softball bats, tennis rackets, golf clubs, hockey sticks, or any other device that may be swung by a user. Moreover, a swingable device does not necessarily have to be a sports device. Thus, for example, the swingable device might be an axe, mallet, pick, or other device that can be swung by a user. Preferably, the swingable device has first and second ends and the first end is adapted to be held by the user. In some cases, the first end of the swingable device has a grip to aid the user in grasping and holding onto the device. Thus, the user holds the first end and swings the device to propel the second end of the device from a first point in space to a second point in space. In the baseball bat example, a batter would grip the bat's handle portion and swing the bat's striking portion back and forth through the air. Typically, the batter would swing the bat in a manner in which the second end of the bat travels in an arc relatively parallel to the ground. It should be noted that this discussion of swingable devices is for example purposes only and various embodiments may have applicability with respect to any device that may be swung by a user.

In general, apparatus 10 may be attached to a swingable device. At least a portion of apparatus 10 is weighted. When attached, at least a part of the weighted portion extends to a point adjacent the free end of the swingable device. The "free end" refers to the end of the swingable device opposite the end gripped by the user. By having the weighted portion at least partially disposed adjacent the free end of the swingable device, the apparatus increases the moment about the vertical axis of the user. In other words, the device feels heavier than if the weighted portion of the apparatus was closer to the user-held end of the device. Thus, various embodiments of the apparatus improve the function of the apparatus in terms of providing, for example, swing training or warm up for a user of the swingable device.

Referring again to FIG. 1, apparatus 10 includes a body portion 12 coupled to a weighted portion 20. These two portions may be coupled in any suitable manner. They may be removably attached, permanently attached, integral, or co-formed as a single unit. In at least one embodiment the entire apparatus is formed as a single, integrated unit.

In at least one embodiment, apparatus 10 comprises two materials—a body material and a weight material. In at least one embodiment, weighted portion 20 comprises both the body material and the weight material. For example, weighted portion 20 may include one or more weight cavities in which weight material 30 is disposed. Weight material 30 may be provided in weight portion 20 in any suitable manner. In at least one embodiment, weight material 30 is formed and the remaining material of weighted portion 20 is formed around weight material 30. Preferably, the parts of apparatus 10 that do not comprise weight material 30 comprise a polycarbonate material formed by an injection molding process in which the polycarbonate material of the weighted portion surrounds the weight material 30. Preferably, there are no gaps between the weight material 30 and the material of apparatus 10 that surrounds weight material 30. Thus, weight material 30 may be prevented from moving around within a cavity of weighted portion 20. It should be understood that this preferred configuration and manufacturing process are examples only, and other embodiments may vary. By way of example only, weight material 30 may, in some embodiments, be formed separately and either attached to, or inserted into, weighted portion 20.

In at least some embodiments the non-weighted material of the apparatus may comprise a mixture of hard plastic and rubber. In certain cases, this mixture may comprise 75-95% hard plastic. In one preferred embodiment the mixtures comprises 80-90% hard plastic. This results in a relatively hard sleeve with little flex, but still allows for a compression/friction fit between the apparatus and the device to which it is attached. The weight material may comprise, for example, steel or lead or any other suitable material. The weighted portion may have different weight amounts based on the intended user of the apparatus. For example, a "youth" baseball bat apparatus might have a weighted portion weighing about 2 ounces. A "high school" baseball bat apparatus might have a weighted portion weighing about 3 ounces. A "college" baseball bat apparatus might have a weighted portion weighing about 4 ounces. A "professional" baseball bat apparatus might have a weighted portion weighing about 5 ounces.

Body portion 12 may be formed to have a substantially cylindrical shape. Body portion 12 has an outer surface 36 an inner surface 34 to define a thickness of body portion 12. Inner surface 34 defines a cavity 37 within body portion 12. Cavity 37 extends from a first end 15 to a second end 17. First end 15 is oriented to be closer to, or proximal, the end of the swingable device gripped by the user when apparatus 10 is attached to the swingable device. Second end 17 is further away from, or distal, the gripped end of the swingable device.

Thus, in the illustrated embodiment, body portion forms a cylinder that is adapted to be slid onto a swingable device, such as, for example, a bat. In at least one embodiment, the cylinder has a first diameter at first end 15, which is smaller than a second diameter at second end 17. Alternatively, the first diameter may be smaller than a second diameter that is located at some point between the first and second ends. In other embodiments, it may be simply stated that the diameter of the cylinder varies along its axis A-A. The variation in the diameter may be a linear increase or decrease in direct proportion to the distance traveled along axis A-A, or the amount of change in the diameter may change in different regions along the axis of the cylinder. In still other embodiments, there is no significant change of diameter of the cylindrical shape of body portion 12.

In at least one embodiment, weighted portion 20 similarly forms a cylinder such that the entire apparatus forms one cylindrical unit. The inner diameter of weighted portion 20 may stay constant or vary in a manner similar to that described in connection with the diameter of body portion 12. In these embodiments apparatus 10 may be viewed as having a first opening 16 closer to, or proximal, the gripped end of the swingable device and a second opening 22 further away from, or distal, the gripped end of the swingable device.

In at least one embodiment, the non-weighted material of apparatus 10 is hard, or stiff, such that there is little or no "give" in the material. Also, the diameter of second opening 22 is larger than the diameter of first opening 16. In this example, apparatus 10 may be slid onto the swingable device, such as a bat, by sliding the second opening onto, over, and past, the first end (e.g., the handle end) of the swingable device. In the bat example, a user might execute this by, for instance, placing the striking end of the bat on the ground and sliding apparatus 10 (second opening 22 first) onto the handle portion of the bat. In cases of swinging devices such as a bat, the device may have a diameter that changes along its length. Moreover, the device may have a striking end with a relatively smaller diameter nearer the handle, and a relatively larger diameter nearer the second end of the device. Apparatus 10 may be slid along the shaft of the bat until the diameter of the first opening 16 of apparatus 10 is equal to the diameter of the corresponding location along the striking portion of the bat. At this point, because the diameter of the bat is increasing in the direction toward the second end of the bat, apparatus 10 is prevented from moving any closer to the second end of the bat. Preferably, the non-weighted material of apparatus 10 either has a little "give" or is itself covered by another material that has some "give." Thus, apparatus 10 might be slid a very slight distance further toward the second end of the bat, with the non-weighted material of apparatus 10 compressing as the diameter of the bat exceeds the natural, non-compressed diameter of first opening 16 of apparatus 10. In this manner, the compressive resistance of apparatus 10 against the bat surface holds apparatus 10 in place axially even when the bat is swung by the user. This may be described, at least in certain embodiments, as a friction-fit configuration.

In at least one alternative embodiment, the non-weighted material of apparatus 10 (at least of body portion 12) is flexible such that the diameter of the cylinder of apparatus 10 may be expanded by pushing the inner surface of apparatus 10 outwardly from the central axis A-A. In these embodiments, apparatus 10 may be slid onto the swingable device (e.g., baseball bat) from either end of the swingable device. If slid onto the swingable device from the first, or handle, end of the device, attaching apparatus 10 to the device is accomplished as already described above. If apparatus 10 is slid onto the second end of the device, then presumably, the first opening 16 of apparatus 10 has a smaller diameter than the second end of the device. Thus, the non-weighted material at first opening 16 is stretched to enlarge the diameter at first opening 16 to a point sufficient to accommodate the diameter at the second end of the device and allow apparatus 10 to be slid onto the device. Preferably, the natural, non-compressed diameter of the cylinder of apparatus 10 is smaller at all points than the corresponding diameters of the device when apparatus 10 is in its final attached position relative to the swingable device. Thus, there is a uniform compressive force of the stationary outer surface of the device pushing outwardly against inner surface 34 of apparatus 10. In this manner, apparatus 10 is compression/friction fit onto the swingable device in a manner similar to that already described.

It should be noted that in certain embodiments not necessarily shown, apparatus 10 may be attached to the swingable device by alternate methods. For instance, apparatus 10 (or at least the body portion 12 of apparatus 10) may be clipped, glued, taped, nailed, stapled, or otherwise attached to any suitable portion of the swingable device by any acceptable technique. Preferably, apparatus 10 is adapted to be removably attached to the swingable device.

Preferably, regardless of the attachment method or configuration with respect to apparatus 10 and the swingable device, weighted portion 20 is at least partially disposed adjacent the second end of the swingable device. In this manner, at least some of the weight of apparatus 10 is disposed adjacent the second end of the device when apparatus 10 is attached to the device. In certain embodiments, the term "adjacent to" can mean at, near, slightly short of, or slightly beyond, the end of the swingable device. Thus, in some embodiments, having at least some of the weight adjacent the end of the device means that at least some of the weight is within, say about one inch, or even more preferably within about one-half inch, of the second end of the device. In some embodiments, some, most, or substantially all the weighted portion 20 is disposed beyond the second end of the device when apparatus 10 is attached to the device.

Figure 4:
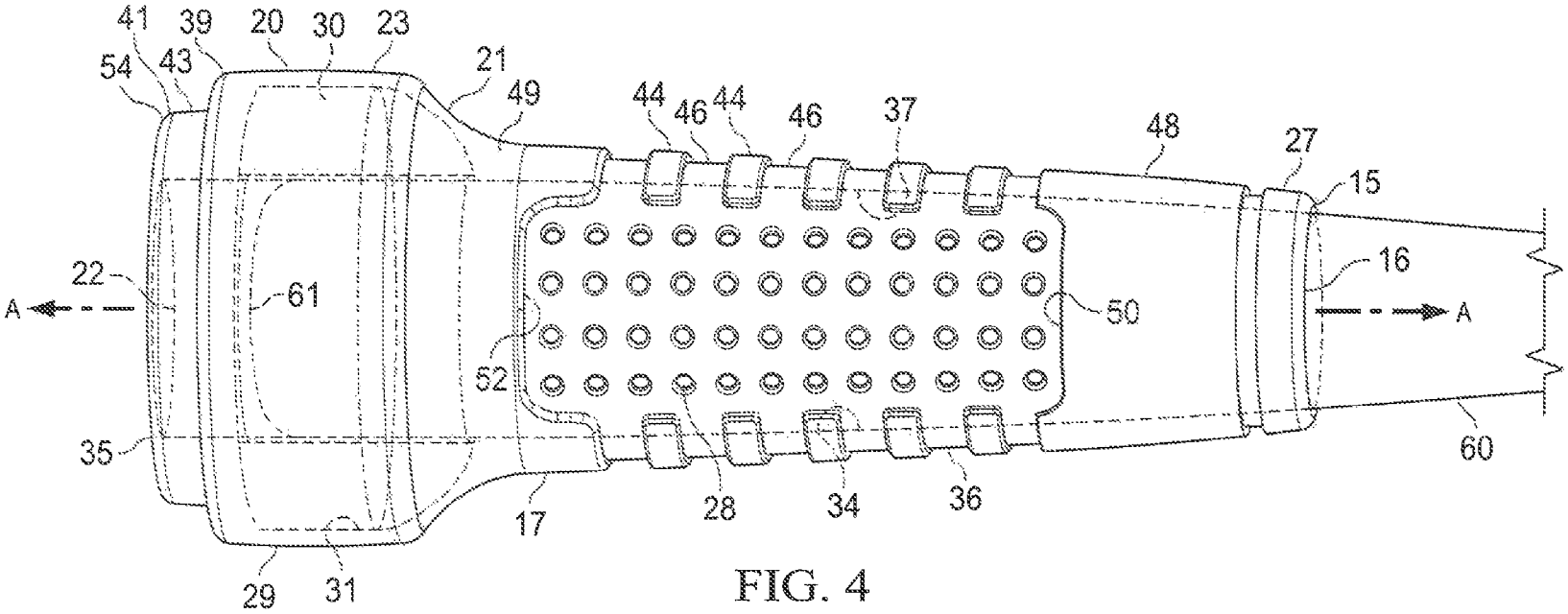
FIG. 4 is a perspective view of an apparatus having a modified body portion according to an example embodiment.

For example, as illustrated in FIG. 4, a swingable device 50 has a free end 51. The body portion of the apparatus is shown as being attached to the swingable device. The weighted portion of the apparatus is shown as being disposed at least partially beyond the striking end of the swingable device.

The apparatus may be viewed as having a midpoint between its first and second ends (i.e., between first opening 16 and second opening 22). In certain configurations, the center of balance of the apparatus is located between the midpoint and the second end. In other embodiments, a majority of the weight of the apparatus is located between the midpoint and second end of the apparatus. In still other embodiments, a majority of the weighted portion is located between the midpoint and second end of the apparatus. In yet other embodiments, substantially all the weighted portion is located between the midpoint and the second end of the apparatus.

In still other embodiments, weighted portion 20 has an associated weight amount. In at least one of these embodiments, at least a portion of the weight amount is disposed adjacent the second end of the device when apparatus 10 is attached to the device. In at least one other embodiment, some, a majority, or substantially all the weight amount is disposed beyond the second end of the device when apparatus 10 is attached to the device.

In other alternate configurations, weighted portion 20 comprises at least two materials. Thus, part of weighted portion 20 may be made of the same material as body portion 12 (or some other relatively light-weight material compared to a weight material described below) and the remaining, non-weight material of apparatus 10. The other of the at least two materials of weighted portion 20 is a weight material 30, which is preferably heavier by volume than the non-weight material of apparatus 10. In at least one of these embodiments, the weight material 30 is at least partially disposed adjacent the second end of the device when apparatus 10 is attached to the device. In other embodiments, some, a majority, or substantially all the weight material is disposed beyond the second end of the device when apparatus 10 is attached to the device.

Weighted portion 20 may comprise a plurality of weight structures 29 disposed about a circumference of weighted portion 20. In one embodiment, there are five weight structures 29. However, the number of weight structures may be varied. Each weight structure 29 comprises a cavity 31, in which weight material 30 is disposed. Weight structure 29 may have any suitable shape. In the embodiment illustrated in FIG. 1, weight structure 29 has a first section 21, a second section 23, and a third section 25. First section 21 extends from a proximal boundary of second section 23 to a proximal end of first section 21. Second section 23 is disposed between first section 21 and third section 25. Third section 25 extends from second end 35 of apparatus 10 to a point where it meets a distal boundary of second section 23. The proximal end of first section 23 may coincide axially with second end 17 of body portion 12, but the precise boundaries of the various sections of weight structure 29 may be varied as desired. Preferably, there is a smooth transition from the outer surface of first section 21 to the outer surface 36 of body portion 12.

In at least one embodiment apparatus 10 is slid onto the swingable device by inserting an end of the swingable device into second end 35 of apparatus 10. Apparatus 10 is then slid along the swingable device. In the bat example, for instance, second end 35 of apparatus 10 would be slid onto the handle end of the bat. Preferably, the swingable device has a shaft and the width of the device varies at points along the shaft. For a baseball bat, as one travels along the shaft, the width (i.e., diameter) increases toward the striking end of the bat. The diameter may reach a maximum amount at some location in the striking portion and may decrease somewhat from that point toward the tip of the bat. Preferably, as apparatus 10 is slid along the swingable device, the width of apparatus 10 will increase to a point that it is slightly greater than an interior diameter of apparatus 10 at first end 15. Thus, apparatus 10 will be prevented from moving any further along the swingable device. Also, it is preferable that there is at least some give in either, or both, of the swingable device and the interior surface of apparatus 10 (at least near first end 15) so that the compressive forces perpendicular to axis A-A of apparatus 10 will hold apparatus 10 in position axially relative to the swingable device.

In the embodiment illustrated in FIG. 1, apparatus 10 includes an interaction region 27. Region 27 is adapted to interact with the exterior surface of the swingable device. First, region 27 prevents relative axial movement of apparatus 10 at some point along a shaft of the swingable device as described above. Region 27 may also provide the compression-force and or friction-fit interaction between apparatus 10 and the swingable device to hold apparatus 10 in position relative to the swingable device.

Figure 2:
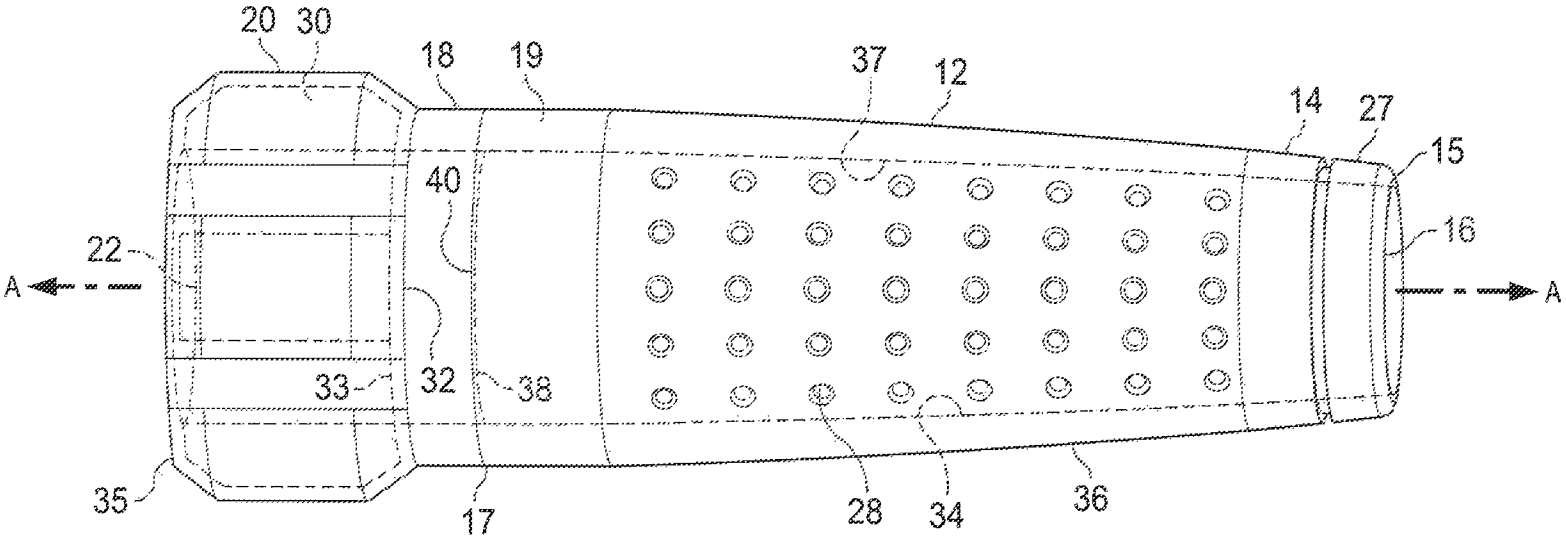
FIG. 2 is a perspective view of an apparatus having a transition portion between a body portion and a weighted portion according to an example embodiment.

In at least one alternate embodiment, as illustrated for example in FIG. 2 the cylinder of body portion 12 does not extend all the way through apparatus 10 along axis A-A. Rather, body portion 12 has first opening 16 at first end 15. The second end 17 of body portion 12 is closed by more of the non-weight material. Thus, there is non-weight material occupying a space defined by proximal surface 38 on the interior of body portion 12 and base surface 33 on the interior of weighted portion 20. The distal end of body portion 12 may alternately be viewed as the end portion defined by material having distal surface 40 and proximal surface 38. In this configuration, a space may be provided between distal surface 40 (or second end 17) of body portion 12 and material forming the base of weighted portion 20. As noted elsewhere, this particular configuration might be useful, for example, when it is desirable to extend or dispose the weighted portion 20, or the weight material 30, even further beyond the second end of the swingable device.

The embodiment in FIG. 2 also illustrates a transition portion 18 between body portion 12 and weighted portion 20. Among other things, transition portion 18 may provide a buffer zone between the body portion 12 and the weighted portion 20. Transition portion 18 may also aid in extending the overall apparatus. This may have the effect of positioning weighted portion 12 further beyond the free end of the swingable device. Transition portion 18 may also provide a transition between a perforated portion of body portion 12 and a non-perforated portion, as described herein in further detail. Or, transition portion 18 may serve as a non-perforated portion of body portion 12, when the remainder of body portion 12 is perforated. In this manner, the transition portion 18 would be stronger in the longitudinal direction of apparatus 10 than would be the perforated portion of body portion 12.

Figure 3:
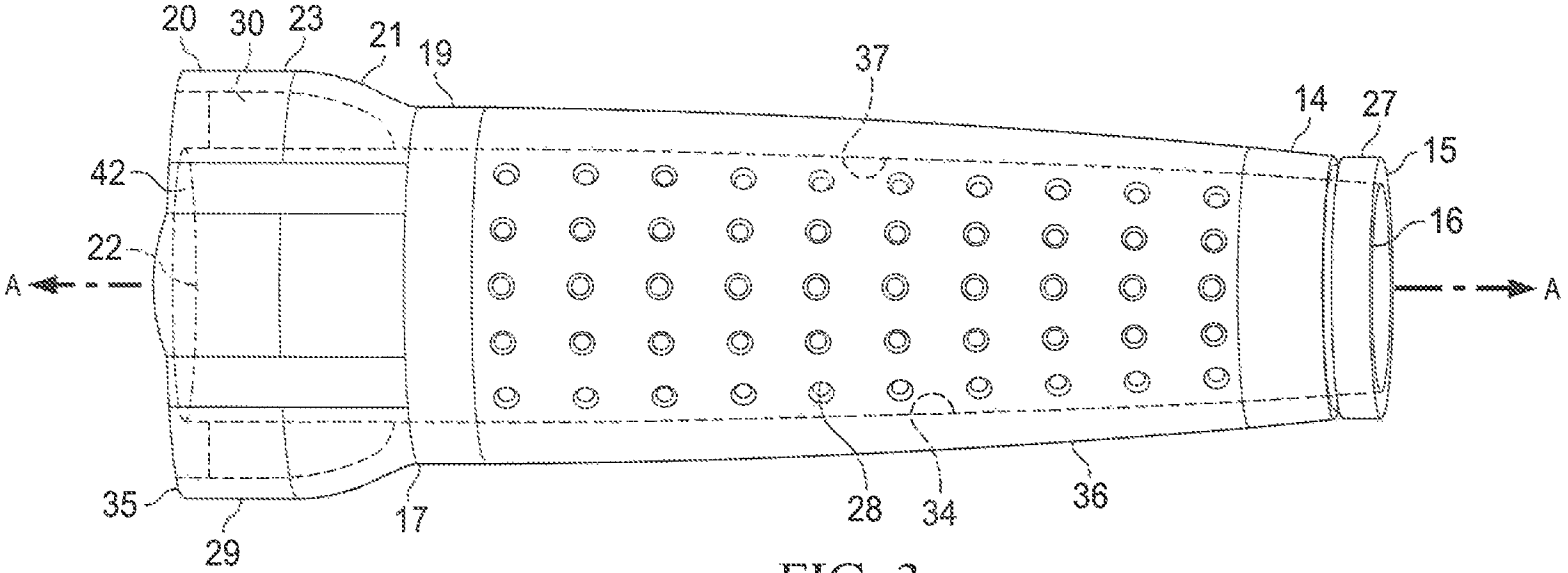
FIG. 3 is a perspective view of an apparatus having a plurality of modified weight structures according to an example embodiment.

In an embodiment illustrated in FIG. 3, it is shown that the end of the weighted region of apparatus 10 may have any suitable shape. As shown in this embodiment, weighted portion 20 has weight structures 29 that have a different profile from those described in connection with FIG. 1. Rather, in the embodiment shown in FIG. 3, a weight structure 29 has first section 21 and second section 23. First section 21 extends from the proximal limit of second section 23 to a point roughly equivalent to the distal, or second, end 17 of body portion 12. Second section 23 extends from second end 35 of apparatus 10 to a distal limit of first section 21. It should be noted that these alternative shapes for the weighted portion 20 are examples only and any suitable shape may be used.

FIG. 4 illustrates yet another alternate embodiment in which weighted portion 20 is smooth. In this embodiment, weighted portion 20 does not have distinct, multiple weight structures. Rather, there is a single weight structure 29 which extends around the entire apparatus 10. Thus, cavity 31 and weight material 30 are cylindrical, or generally donut- or ring-shaped. An end structure 41 is also provided to extend from a distal end 39 of weight structure 29 to second end 35 of apparatus 10. End structure 41 is shown as comprising first section 43 and second section 54. Second section 54 is shown as tapered from the distal end of first section 43 to second end 35 of apparatus 10.

Weight structure 29 includes first section 21 and second section 23. First section 21 extends from a proximal end of second section 23 to a second end 17 of body portion 12. Preferably there is a smooth transition from first section 21 to body portion 12. Also, the proximal end of first section 21 does not have to correspond exactly with the second end 17 of body portion 12. Second section 23 of weight structure 29 extends from the distal end of first section 21 to the distal end 39 of weighted portion 20. It should be understood that weighted portion 20 may also be viewed as including all or part of end structure 41. Further, end structure 41 may house some, none, or all of weight material 30 (not expressly shown in FIG. 4).

In the embodiment illustrated in FIG. 4, outer surface 36 of body portion 12 has a plurality of raised surfaces 44, between which exist depressions 46. Among other things, raised portions 46 provide a gripping mechanism for a user to grasp apparatus 10 in order to help in attaching apparatus 10 to the swingable device.

In some embodiments, at least a part of body portion 12 includes perforations 28. In the example illustrated in FIG. 1, there are two end areas 14 and 19 of body portion 12 that are not perforated. The perforations reduce the weight associated with body portion 12 relative to weighted portion 20 (and also transition portion 18 in the applicable embodiments). As shown, for example, in FIG. 4, the non-perforated end portions (48 and 49 in FIG. 4) may be of any suitable shape and configuration. In FIG. 4, one non-perforated end portion 48 has at least one recessed portion 50 and the other non-perforated end portion 49 has at least one recessed portion 52. Among other things, the recessed portions accommodate additional perforated surface area.

The perforations may be of any suitable shape, dimension, spacing, and disposition on body portion 12. For example, while the perforations in at least some illustrated embodiments are circular, in other embodiments (not expressly shown) the perforations may be slotted (either axial or transverse or in some other orientation with respect to axis A-A). In other examples, the perforations could be square, diamond, triangular, or any other desirable shape. In still other embodiments, perforations may be provided on other parts of apparatus 10 instead of, or in addition to, body portion 12.

It should be understood that FIGS. 1-4 illustrate example embodiments of the apparatus and various aspects of the apparatus may be added, eliminated, and/or substituted for those shown. Such modifications may be made as is desired, suitable, and/or advantageous for performing the functionality described herein.

Numerous other changes, substitutions, variations, alterations, and modifications may be ascertained by those skilled in the art and it is intended that the present invention encompass all such changes, substitutions, variations, alterations and modifications as falling within the spirit and scope of this description.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A bat training apparatus, for use on a bat having a first end with a handle and a second end with a barrel and a taper region extending therebetween, the apparatus comprising:

a cylindrical structure having a first end portion and a second end portion, the apparatus adapted to be disposed on the bat in a seated position by sliding the cylindrical structure onto the handle of the bat and further sliding the cylindrical structure along the bat toward the barrel of the bat such that the first end portion of the cylindrical structure is disposed toward the handle end of the bat on the taper region and the second end portion of the cylindrical structure is disposed over the barrel of the bat;

the cylindrical structure comprising an interaction region, a weight portion, and a body portion connecting the interaction region to the weight portion;

the weight portion formed proximate the second end of the apparatus and having a single permanent annular weight cavity formed therein, the annular weight cavity surrounding a longitudinal axis of the apparatus in one continuous annular ring, the weight portion further comprising an annular weight fixedly and permanently disposed within the annular weight cavity;

the interaction region being formed proximate the first end portion of the apparatus and having an inner surface adapted to interact with a surface of the bat such that when the cylindrical structure is slid onto the bat an inner surface of the interaction region substantially at a first end of the apparatus will contact the surface of the taper region of the bat to engage the bat and hold the cylindrical structure in a compression friction fit against the bat in the seated position; and the body portion having a first region in which is formed a plurality of lightening holes, the lightening holes reducing weight of the cylindrical structure in the body portion and acting to shift a center of gravity of the apparatus toward the second end of the apparatus as compared to an apparatus having a body portion without the plurality of lightening holes, the body portion also having a second region, wherein the first region comprises a rigid material and the second region comprises a flexible material.

2. The apparatus of claim 1, wherein the apparatus comprises a first layer adapted to be disposed next to the bat when the apparatus is placed onto the bat, and a second layer overlying at least a portion of the first layer, the first and second layers each extending from the first end of the apparatus to the second end of the apparatus.

3. The apparatus of claim 2, wherein the annular weight cavity is formed between the first layer and the second layer.

4. The apparatus of claim 2, wherein the annular weight cavity is formed within the second layer.

5. The apparatus of claim 2, wherein the annular weight cavity is formed within the first layer.

6. The apparatus of claim 1, wherein the second region of the body portion further comprises the rigid material.

7. The apparatus of claim 1, wherein all of an inner surface of the weight cavity is in contact with the weight.

8. The apparatus of claim 1, wherein the interaction region has partial non-continuous contact with surface of bat when the apparatus is in the seated position.

9. The apparatus of claim 1, wherein the plurality of lightening holes create drag and wind resistance when the bat is swung with the apparatus disposed on the bat.

10. The apparatus of claim 1, wherein the weight portion is at least partially disposed beyond the second end of the bat when the apparatus is disposed on the bat in the seated position.

11. The apparatus of claim 1, wherein the weight is at least partially disposed beyond the second end of the bat when the apparatus is disposed on the bat in the seated position.

12. The apparatus of claim 1, the apparatus having a first inner diameter at the first end and a second inner diameter at the second end, the first inner diameter being less than the second inner diameter, and an inner diameter of the apparatus tapering from the first inner diameter to the second inner diameter.

13. The apparatus of claim 1, wherein the interaction region of the bat contacts the surface of the bat at the taper region of the bat, without the apparatus contacting the barrel of the bat.

14. The apparatus of claim 1, wherein a distal end of the second end portion extends beyond the barrel of the bat when the apparatus is disposed on the bat in the seated position.

* * * * *